US011427452B2

(12) United States Patent
Clüsserath et al.

(10) Patent No.: US 11,427,452 B2
(45) Date of Patent: Aug. 30, 2022

(54) CONTAINER FILLING ARRANGEMENT FOR FILLING BOTTLES AND SIMILAR CONTAINERS WITH A BEVERAGE AND A METHOD OF OPERATING THE CONTAINER FILLING ARRANGEMENT

(71) Applicants: Ludwig Clüsserath, Bad Kreuznach (DE); Achim Kunz, Simmern (DE)

(72) Inventors: Ludwig Clüsserath, Bad Kreuznach (DE); Achim Kunz, Simmern (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 17/505,737

(22) Filed: Oct. 20, 2021

(65) Prior Publication Data

US 2022/0041424 A1 Feb. 10, 2022

Related U.S. Application Data

(63) Continuation-in-part of application No. PCT/EP2020/058918, filed on Mar. 30, 2020.

(30) Foreign Application Priority Data

Apr. 25, 2019 (DE) ..... 102019110665.6

(51) Int. Cl.
*B67C 3/26* (2006.01)
*B67C 3/00* (2006.01)
(Continued)

(52) U.S. Cl.
CPC ..... *B67C 3/002* (2013.01); *B08B 9/0325* (2013.01); *B67C 3/007* (2013.01); *B67C 3/225* (2013.01);
(Continued)

(58) Field of Classification Search
CPC ..... B67C 3/001; B67C 3/002; B67C 3/004; B67C 3/007; B67C 3/225; B67C 3/26;
(Continued)

(56) References Cited

U.S. PATENT DOCUMENTS 4,848,381 A * 7/1989 Livingston ..... A23G 7/00 134/57 R
6,014,994 A * 1/2000 Schmidt ..... B67C 3/001 134/170

(Continued)

FOREIGN PATENT DOCUMENTS

| | | |
|---|---|---|
| DE | 102008030291 | 12/2009 |
| EP | 0672613 | 9/1995 |
| EP | 1215166 | 6/2002 |

*Primary Examiner* — Nicolas A Arnett
(74) *Attorney, Agent, or Firm* — Myers Duffy Dansak & Clegg LLC

(57) ABSTRACT

In order to perform a cleaning-in-place or CIP cleaning of a filling element of a filling machine for the filling of containers with a liquid filling content, at least one closure element can be used, together with the filling element, to form a flushing chamber, in which a filling valve and a filling-level probe are at least partially disposed for the cleaning-in-place cleaning of the filling element. A control unit controls the flow of cleaning medium into the flushing chamber and the performance of at least one electrical measurement with the filling-level probe during the cleaning-in-place cleaning of the filling element.

20 Claims, 4 Drawing Sheets

(51) Int. Cl.
*B08B 9/032* (2006.01)
*B67C 3/22* (2006.01)

(52) U.S. Cl.
CPC ..... *B67C 3/26* (2013.01); *B08B 2209/032* (2013.01); *B67C 2003/2685* (2013.01)

(58) Field of Classification Search
CPC ..... B67C 2003/2685; B08B 9/0325; B08B 2209/032
See application file for complete search history.

(56) References Cited

U.S. PATENT DOCUMENTS

| | | | | |
|---|---|---|---|---|
| 6,161,558 | A * | 12/2000 | Franks | B08B 9/0321 134/103.1 |
| 7,614,410 | B2 * | 11/2009 | Kenowski | B08B 9/0325 134/100.1 |
| 7,650,916 | B2 * | 1/2010 | Clusserath | B67C 3/04 141/95 |
| 8,096,330 | B2 * | 1/2012 | Mazzon | B08B 3/02 141/91 |
| 8,505,268 | B2 * | 8/2013 | Stoiber | B67B 3/26 53/55 |
| 8,757,225 | B2 * | 6/2014 | Knieling | B67C 3/023 141/104 |
| 8,844,585 | B2 * | 9/2014 | Laumer | B67C 3/001 141/91 |
| 9,714,161 | B2 * | 7/2017 | Riggio | B67C 3/26 |
| 10,640,250 | B2 * | 5/2020 | Clusserath | B67C 3/28 |
| 10,994,977 | B2 * | 5/2021 | Ziegler | B67C 3/20 |

* cited by examiner

CONTAINER FILLING ARRANGEMENT FOR FILLING BOTTLES AND SIMILAR CONTAINERS WITH A BEVERAGE AND A METHOD OF OPERATING THE CONTAINER FILLING ARRANGEMENT

CROSS-REFERENCE TO RELATED APPLICATIONS

The present application is a Continuation-in-Part of International Patent Application No. PCT/EP2020/058918, filed Mar. 30, 2020, which claims the benefit of Federal Republic of Germany Patent Application No. DE102019110665.6, filed Apr. 25, 2019, each of which is incorporated by reference herein in its entirety.

BACKGROUND INFORMATION

1. Technical Field

The present application relates to a container filling arrangement for filling bottles and similar containers with a beverage and a method of operating the container filling arrangement.

Beverage bottle filling machines, or simply filling machines, are used in the beverage bottle filling or bottling industry to fill bottles with a liquid beverage. Such machines can be of a rotary or linear design. Rotary beverage bottle filling machines include a rotary carousel or rotor or similar structure that has a plurality of individual beverage bottle filling devices or beverage bottle filling stations mounted or positioned on the perimeter or periphery thereof. In operation, an individual beverage bottle is received or picked up from a bottle or container handling device or machine, such as another bottle treatment machine or a container transport or conveyor, which can be either of a rotary or linear design, and held at a corresponding individual filling device or station. While the rotary carousel rotates, each individual filling device or filling station dispenses a beverage, such as soft drinks and sodas, wine, beer, fruit juices, water, or other beverages, or another liquid product. Each individual filling device is usually designed to fill one beverage bottle or similar container at a time. Upon completion of filling, the beverage bottle or container is released or transferred to yet another bottle or container handling device or machine, such as another bottle treatment machine or transport device. The filling devices are therefore designed to fully dispense a predetermined or desired amount or volume of product into the beverage bottles or containers before the beverage bottles or containers reach the exit or transfer position out from the filling machine. The beverage bottle filling machine can also be of a linear design, wherein beverage bottles are moved to one or more filling positions along a straight or linear path.

Such filling machines are usually part of a filling or bottling plant, wherein the filling machine operates in conjunction with a number of other beverage bottle or container handling machines, such as a closing machine for placing caps or closures on filled containers, a container manufacturing machine for making or forming containers to be filled, and a container packaging machine for packaging individual containers for shipment and sale to consumers. Such plants are designed to operate as quickly and continuously as possible, and any interruptions in operation result in a loss of productivity and an increase in operating costs, especially since such plants can process large numbers of containers, such as, for example, anywhere from ten to seventy thousand containers per hour or possibly more.

The application relates to a method for the cleaning-in-place (CIP) cleaning of at least one filling element of a filling machine according to at least one possible exemplary embodiment, and to a filling machine for filling containers with liquid contents according to at least one possible exemplary embodiment.

Filling machines for filling containers with liquid contents comprise filling elements, which, for example, after a specific period of time or at the change of the filling contents must be cleaned, disinfected, or sterilized. This serves the purposes of hygiene, and prevents the contamination of filling contents with the residues of the previous filling contents. For cleaning the filling elements, CIP cleaning is often used effectively in the beverage bottling and container filling industry.

2. Background Art

This section is for informational purposes only and does not necessarily admit that any publications discussed or referred to herein, if any, are prior art.

By way of example, in at least one type of filling machine, for the CIP cleaning, a flushing cap can be placed onto each filling element, which accommodates the respective filling tube in a flushing chamber which can be sealed tight to the outside. During the CIP cleaning, cleaning agents then flow, among other ways, through a ring channel, through opened liquid channels of the filling elements, past liquid valves and their valve seats, through the filling tube channel of each filling tube, through the flushing chamber, and past the outer side of the filling tube through a gas passage into a further ring channel.

In such a filling machine it cannot be checked, or at least cannot be checked with ease and efficiency, whether in fact every filling element has been cleaned, and that it is therefore also impossible or very difficult to provide proof of complete or substantially effective or optimal cleaning of the filling machine.

SUMMARY

Taking some of the current filling machines as a starting point, the object of the present application is based on providing an improved method for the CIP cleaning of filling elements of a filling machine, and a correspondingly improved filling machine, which allow for checking of the cleaning and/or sterilization of the filling elements, and therefore make it possible to promote a complete cleaning of the filling machine, or at least as complete as possible, or at least to predetermined level of cleanliness.

The object can be achieved by a method for CIP cleaning of at least one filling element of a filling machine according to at least one possible exemplary embodiment, and by a filling machine for the filling of containers with a liquid content according to at least one possible exemplary embodiment.

Proposed is a method for the CIP cleaning of at least one filling element of a filling machine. In this situation, the CIP cleaning also comprises the sterilization-in-place (SIP) cleaning, since this represents a specific type of CIP cleaning. With CIP cleaning, the filling element can be cleaned fixed in place, that is, at its installed position, without the need for it to be dismantled or removed from the filling machine.

The filling machine can be configured for the filling of containers with a liquid filling product. Containers are understood in this situation to be, for example, to be other containers in the form of bottles, cans, party cans, or kegs. The filling machine comprises a multiplicity of filling positions on a circulating transport element. In this situation, each filling position comprises a filling element with a filling valve. As a supplement, the filling element can also comprise an electric filling-level probe or also a long filling tube configured as an electric probe. Hereinafter, both the electric filling-level probe as well as the electric probe are designated as an electric filling-level probe. In addition, the filling position can also comprise a container carrier for carrying the containers. By way of the filling valve, to which the filling tube can be connected, the liquid filling contents pass from the filling machine into the containers. In this situation, the electric filling-level probe monitors what level the liquid filling contents has reached in the container. As soon as a predetermined level has been reached, the filling of the containers can be stopped. The electric filling-level probe operates in this situation in accordance with the principle that an electric circuit can be closed by the liquid filling contents, wherein this closing of the circuit can be recognized by corresponding measuring devices.

For the CIP cleaning, the filling valve and the electrical filling-level probe are now accommodated in a flushing chamber, which can be provided by a closure element. In this situation, the closure element can be formed, for example, as a flushing cap or a flushing sleeve. Accordingly, at least one cleaning medium can be introduced into the flushing chamber, by which the filling element can be cleaned. In this way, the filling valve can be cleaned from the outside as well as from the inside.

As the cleaning medium, use can be made of widely differing cleaning liquids, as well as other treatment media, such as, among other, disinfection media, acids, and alkalis. In this situation it can be possible to make use of different cleaning media in different cleaning steps. Water can also be understood to be a cleaning medium, which can be used, according to at least one possible exemplary embodiment, as the cleaning medium for flushing in a last cleaning step.

According to at least one possible exemplary embodiment, during the CIP cleaning at least one measurement can be carried out with the electric filling-level probe. In this situation the cleaning medium closes a circuit with the electric filling-level probe, as a result of which it can be identified that cleaning medium is present in the flushing chamber. It can therefore be checked for each filling element as to whether cleaning medium is present in the flushing chamber or not, and therefore the correct performance of the cleaning can be checked. If this check is carried out at all steps of the cleaning process, and on all the filling elements, it can be possible to provide proof of a complete cleaning of the filling machine. In accordance with at least one possible exemplary embodiment, the CIP cleaning of the filling element can be substantially improved, and even without the need for additional components. In other words, by monitoring for the presence of cleaning medium in the flushing chamber during the cleaning step or steps, it can reasonably be deduced that a desired or predetermined cleaning process was carried out to the desired extent or level sufficient to clean the components of the filling machine to a desired level of cleanliness. Conversely, if the presence of cleaning medium is not detected during a cleaning step or steps, then it can reasonably be deduced that a desired or predetermined cleaning process was not carried out to the desired extent or level sufficient to clean the components of the filling machine to a desired level of cleanliness. Therefore, by using the method and device according to at least one possible exemplary embodiment, while a complete or desired or predetermined cleaning cannot be guaranteed, it can be reasonably deduced and expected that a complete or desired or predetermined cleaning has been performed that achieves a level of cleanliness sufficient to permit operation of the filling machine to fill containers with minimized contamination of the containers and the filling product in the containers.

According to at least one possible exemplary embodiment, the closure element can be suspended manually at the filling position and/or automatically activated. With the manual suspension of the closure element, it is possible for the closure element to be stored separately from the filling machine, and used only when required for a CIP cleaning. Additionally, with manual suspension, no elaborate mechanism is needed to carry out the suspension of the closure element. However, if the closure element is activated automatically, the CIP cleaning can be carried out more rapidly, and less effort is required on the part of the personnel. There is likewise no risk of contamination of the closure element or of the filling machine by the personnel. Finally, it can also be conceivable for the closure element to be suspended manually and then activated automatically. To further explain, closure elements can be suspended or installed manually, that is, they are separate from the filling machine and can be installed by hand by personnel prior to performing the CIP cleaning procedure. Alternatively, the closure elements can be held by an automated mechanism at the filling machine that automatically and mechanically moves the closure elements into position for the CIP cleaning. A combination of these two approaches can also be performed, wherein personnel manually place the closure elements in an automated installation mechanism for the CIP cleaning procedure.

According to at least one possible exemplary embodiment, actuatable valves can be arranged in gas channels and/or liquid channels of the filling machine, which valves can be opened and/or closed in such a way that the cleaning medium can be conveyed in a circuit through the filling valve. At least a part flow of the cleaning medium then also goes through the flushing sleeve. The cleaning medium therefore can be repeatedly conveyed past the filling valve, and by this repeated or continuous or frequent flow the cleaning can be optimized or improved still further.

According to at least one possible exemplary embodiment, the measurement can be carried out between a measurement region of the filling-level probe and an electrical ground region. Both the measurement region as well as the electrical ground region are configured in this case as electrically conductive and are electrically isolated from one another. In accordance with at least one possible exemplary embodiment, the electrical ground region can have an electrical potential of zero volts, but does not necessarily need to be zero volts, and thus could have a non-zero voltage in at least one possible exemplary embodiment. In accordance with at least one possible exemplary embodiment, the measurement can be carried out between the measurement region and an electrical ground region of the filling-level probe. For this purpose, an electric voltage can be imposed between the measurement region and the electrical ground region, and the electric current flow derived then can be measured directly or indirectly. A current flow in this situation indicates the presence of an electrically-conductive liquid between the measurement region and the electrical ground region, while the absence of a current flow indicates that the measurement region continues to be electrically isolated from the electrical ground region.

In accordance with at least one possible exemplary embodiment, a periodic voltage can be imposed to carry out a measurement at the measurement region of the filling-level probe. This therefore avoids electrolysis occurring at the measurement region and/or the electrical ground region, such as can be the case with a direct current or DC voltage. In accordance with at least one possible exemplary embodiment, this periodic voltage is a square-wave voltage, which allows for a relatively simple measurement of the amount of the electric current flow.

In at least one possible exemplary embodiment, the presence of a cleaning medium can be checked, since this also checks the cleaning of the filling element and allows for proof of a complete cleaning of the filling machine. It can be assumed that a cleaning medium is present if the electric current flow between the measurement region and electrical ground region exceeds a specific and relatively low limit. Such a measurement can be carried out relatively easily. However, in accordance with at least one possible exemplary embodiment, the value of the electrical conductivity of the medium that is present between the measurement region and electrical ground region can be measured. If the measured conductivity is compatible or generally consistent with a predetermined or known conductivity of the cleaning medium within a certain tolerance range, it can be assumed that the filling element is being successfully cleaned. This measurement can be relatively more elaborate than the measurement described heretofore of only the presence of a cleaning medium, but in return the measurement of the electrical conductivity provides additional information. Instead of the electrical conductivity, it can also be possible to measure the value of an electric current flow between the measurement region of the filling-level probe and an electrical ground region, the value of a voltage drop in the measurement circuit, and/or the value of an electrical resistance between the measurement region of the filling-level probe and an electrical ground region, since these measurements are in principle equivalent to one another, provided that the geometry between the measurement region and the electrical ground region is known.

In at least one possible exemplary embodiment, the measurement can be carried out with a resistor. With a known or determined voltage drop at the series resistor or between the measurement region and the electrical ground region, and with a known voltage being imposed, it is then relatively easy to calculate the electrical resistance between the measurement region and electrical ground region, and therefore the electrical conductivity of the cleaning medium. In at least one possible exemplary embodiment, the series resistor can be adjusted in this situation in such a way that as precise a measurement as possible can be achieved of the resistance between the measurement region and the electrical ground region.

In at least one possible exemplary embodiment, a reference measurement of the electrical conductivity of the cleaning medium can be carried out, such as by using a conductivity measuring device installed in a gas channel and/or liquid channel. This reference measurement can be therefore used as a basis for the check as to whether the medium measured by the filling-level probe exhibits approximately the same conductivity as the cleaning medium. In at least one possible exemplary embodiment, the temperature of the cleaning medium also can be measured at the point at which the reference measurement of the electrical conductivity can be carried out.

In at least one possible exemplary embodiment, the temperature of the cleaning medium can be determined from the electrical conductivity measured by the filling-level probe. Due to the dependency of the temperature on the electrical conductivity of liquids, the temperature of the cleaning medium in the region of the filling-level probe can be calculated from the conductivity measured by the filling-level probe together with the reference measurement of the electrical conductivity and the temperature at this reference measurement. In this situation, deviations in this temperature from an anticipated temperature may be an indicator of problems with the cleaning of the filling element.

In at least one possible exemplary embodiment, at least some measurement results can be passed on, for example to a central data processing system, and/or can be displayed. It is therefore possible for the cleaning of the filling machine to be checked in the central data processing system.

By the displaying the measurement results, it can also be possible for the cleaning of the filling machine to be subsequently proved or deduced, or possible defects to be identified.

In at least one possible exemplary embodiment, at a predetermined time after the identification of the cleaning medium by at least one filling-level probe, a following cleaning step can be initiated, or, if this involves the last cleaning medium in the cleaning process, such as water for flushing, the cleaning can be concluded. This predetermined period of time can be zero if it is only important that the cleaning medium has reached the filling element. The predetermined time can also be greater than zero, however, if it is intended that the cleaning medium should be allowed to take effect on the filling element for a particular period of time. In at least one possible exemplary embodiment, the predetermined period of time can be different depending on the cleaning medium. In at least one possible exemplary embodiment, the predetermined period of time first begins to run when the filling-level probes have identified the cleaning medium at all the filling elements which are to be cleaned. Without a recognition of the cleaning medium, the CIP cleaning can be carried out in such a way as if the cleaning medium has reliably reached all the filling elements, i.e., a certain time buffer can be built in, such that a reliable cleaning of the filling elements can be guaranteed or promoted or optimized. This time buffer can be avoided by the recognition of the cleaning medium by filling-level probes, which speeds up the CIP cleaning.

Further proposed is a filling machine for the filling of containers with liquid contents. The term "container" in the context of this application is understood to mean, for example, bottles, other bottle-like containers, cans, party cans, or kegs. The filling machine comprises a multiplicity of filling positions on a circulating transport element or rotor or carousel. In this situation, each filling position comprises a filling element with a filling valve and an electrical filling-level probe, or a long filling tube configured as an electrical probe. In addition, the filling position can also comprise a container carrier for carrying the containers. By way of the filling valve, to which a filling tube can be connected, the liquid contents pass from the filling machine into the containers. In this situation the electrical filling-level probe checks what level the liquid filling content has reached in the container. As soon as a predetermined level has been reached, the filling of the container can be stopped. The electrical filling-level probe operates in this situation on the principle that an electrical circuit can be closed by the liquid filling contents, wherein this closing of the circuit can be identified by corresponding measuring devices. For the CIP cleaning of the filling element, the filling valve and the electrical filling-level probe can be accommodated in a flushing chamber provided by a closure element. The closure element can in this situation be suspended manually in the filling position and/or activated automatically. At the CIP cleaning, at least one cleaning medium can be then introduced into the flushing chamber, such that the filling element can be cleaned.

According to at least one possible exemplary embodiment, the filling machine comprises a control device, which can be configured in such a way as to carry out at least one possible exemplary embodiment of the method in accordance with the foregoing description. In at least one possible exemplary embodiment, therefore, during the CIP cleaning, at least one measurement can be carried out with the electrical filling-level probe. In this situation, the cleaning medium closes the circuit of the filling-level probe, as a result of which it can be recognized or determined or deduced that cleaning medium is present in the flushing chamber. It is therefore possible for a check to be made for each filling element as to whether cleaning medium is present in the flushing chamber or not, and therefore the cleaning itself can be checked. If this check is carried out at all the cleaning steps and on all the filling elements, it is possible to prove a complete cleaning of the filling machine, or at least permit a reasonable deduction or conclusion that a cleaning of the filling machine has been performed to a desired or satisfactory level of cleanliness.

In at least one possible exemplary embodiment, a measuring electronics unit of the filling-level probe comprises an adjustable series resistor. Since the electrical conductivity values of, for example, water used for the flushing on the one hand, and alkalis or acids used for cleaning on the other hand, in part differ from one another, for example, by more than two orders of magnitude, the adjustable series resistor allows for a precise measurement result to be obtained over this range of conductivity values.

In at least one possible exemplary embodiment, the filling machine can comprise at least one conductivity measuring device installed in a gas channel and/or liquid channel for measuring a reference conductivity. From the comparison of the reference conductivity with the conductivity measured by the filling-level probe, it can be concluded, or at least reasonably deduced or determined, whether the medium measured by the filling-level probe is the desired cleaning medium or not.

Further embodiments, advantages, and possible applications of at least one or more possible exemplary embodiments disclosed in this application are also derived from the following description of exemplary embodiments and from the figures. In this context, all the features described and/or represented in the figures can be utilized, alone or in any desired combination, in at least one possible exemplary embodiment.

DETAILED DESCRIPTION

Identical reference numbers are used in the figures for elements of at least one possible exemplary embodiment that are the same or have the same effect. In addition, for the sake of easier overview, only reference numbers are represented in the individual figures which are necessary for the description of the respective figure.

Figure 1:
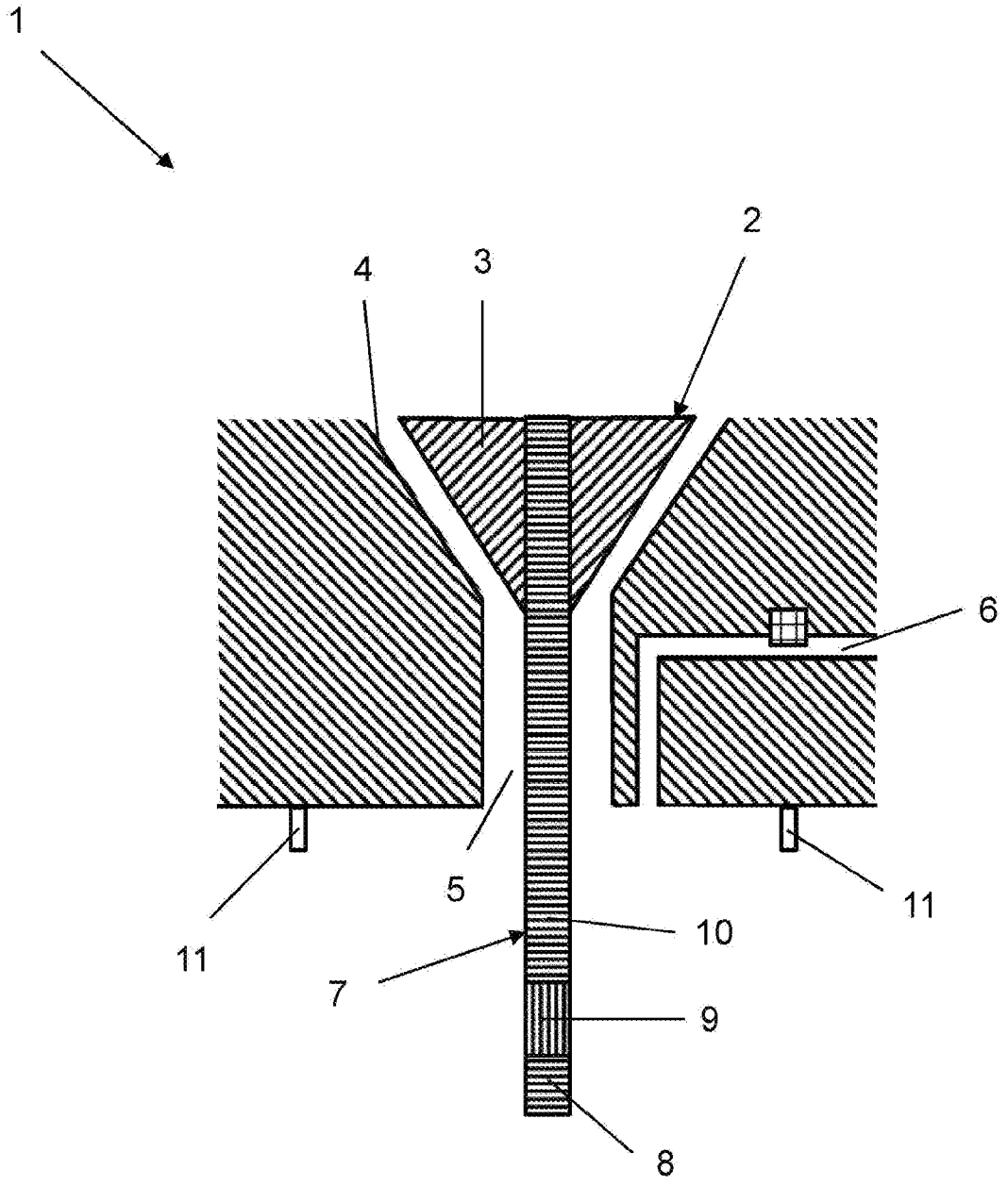
FIG. 1 shows a schematic cross-sectional view of a filling element according to at least one possible exemplary embodiment.
Figure 1A:
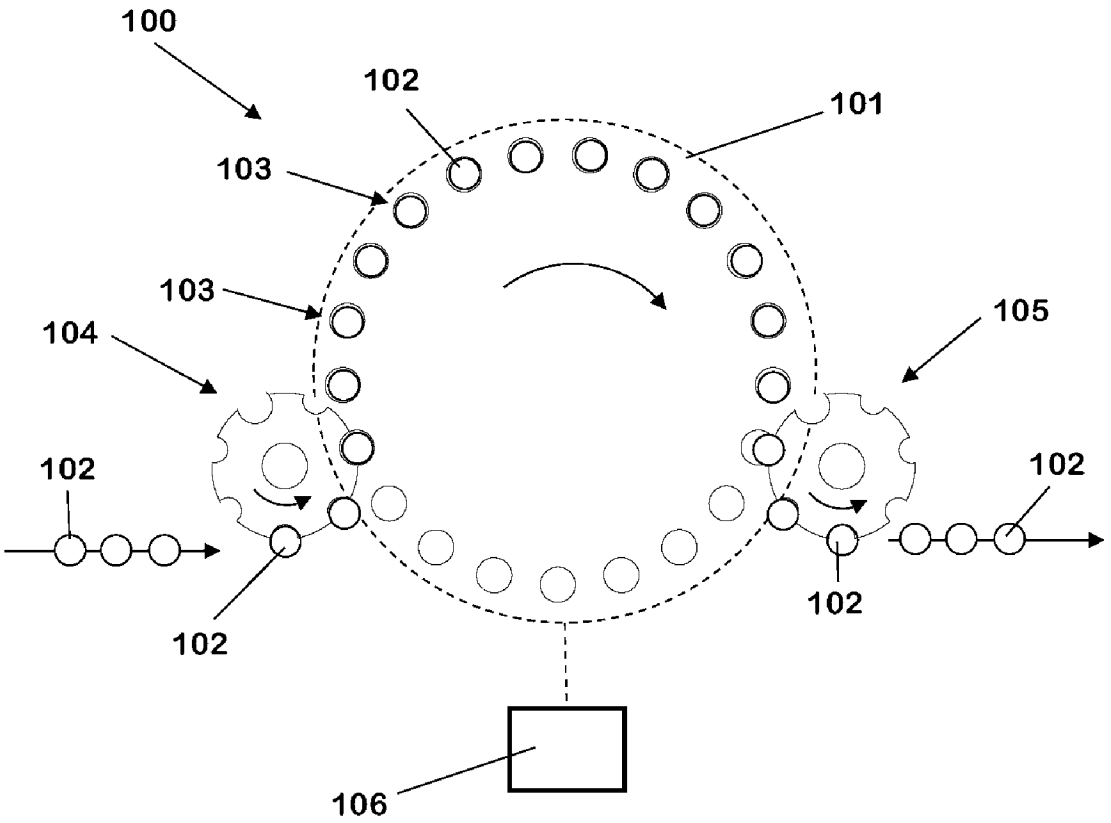
FIG. 1A shows a schematic top view of a container handling or beverage bottling machine in accordance with at least one possible exemplary embodiment.

FIG. 1A shows a schematic top view of a container handling or beverage bottling machine 100 for handling containers 102, such as bottles, cans, kegs, or similar containers, in accordance with at least one possible exemplary embodiment. The container handling machine 100 comprises a rotor or carousel 101 designed to rotate about a vertical axis of rotation. A plurality of container handling arrangements 103 are disposed about the periphery of the rotor 101. The container handling arrangements 103 can be designed to perform different functions depending on the container handling machine 100, such as container filling, closing, labeling, and other such container handling functions. A first rotary container transport device 104, such as a star wheel or similar device, moves containers 102 into the container handling arrangements 103. A second rotary container output device 105, such as a star wheel or similar device, moves containers 102 out of the container handling arrangements 103. A control arrangement 106, such as a computer control arrangement, is operatively connected to the container handling machine 100 to control and/or monitor the operation of the container handling machine 100 and the components thereof.

FIG. 1 shows a schematic section through a filling element 1 of a filling machine for the filling of containers with liquid filling contents. The filling element 1 comprises a filling valve 2, which is represented here by a cone 3, which interacts with a cone-shaped cut-out opening 4 in the filling element 1. This representation of the filling valve 2 is to be understood as only exemplary and schematic. Many other forms of a filling valve 2 are conceivable and possible, and these have no effect on the present invention.

During the filling of a container, not represented here, which is preferably located beneath the filling valve 2, the filling valve 2 is opened, such that the liquid filling contents can flow into the container via the filling valve 2 and a liquid channel 5, which is in fluid connection with the filling valve. Air which emerges from the container during the filling is conveyed away in this situation via a gas channel 6.

Furthermore, a filling-level probe 7 is arranged centrally, which is configured in the form of a bar or rod, and connects to the filling valve 2 in the direction of the container. The filling-level probe 7 comprises on its lower end, i.e., the end opposite the filling valve 2, an electrically-conductive measurement region 8. This measurement region 8 is separated by an isolating region 9 from an electrical ground region 10 of the filling-level probe 7, which is likewise electrically conductive. During the filling of containers, the mode of function of such a filling-level probe 7 is such that, first, an electric voltage U, such as a periodic electric voltage U, is imposed between the measurement region 8 and the electrical ground region 10. Since the measurement region 8 and the electrical ground region 10 are separated by the isolating region 9, initially no current flows in the associated circuit, since no electrically-conductive connection pertains between the measurement region 8 and the electrical ground region 10 of the filling-level probe 7.

In accordance with at least one possible exemplary embodiment, the filling-level probe 7 extends into the container which is to be filled, and, specifically, the transition between the isolating region 9 and the electrical ground region 10 comes to lie in the region of the desired filling level of the filling contents in the container. Next, the filling valve 2 is opened, and the filling contents is filled into the container via the filling valve 2 and the liquid channel 5 connected to it.

If the liquid level or the filling level of the filling contents in the container now rises sufficiently far that it exceeds the transition between the isolating region 9 and the electrical ground region 10, then, via the conductive liquid, the circuit is closed between the measurement region 8 and the electrical ground region 10. Due to the voltage U imposed, current can now flow in the circuit. The desired filling level of the filling contents in the container is therefore attained, and the filling valve 2 can be closed again.

The filling element 1 further comprises a connection device 11 for connecting a closure element 12 to the filling element 1.

Figure 2:
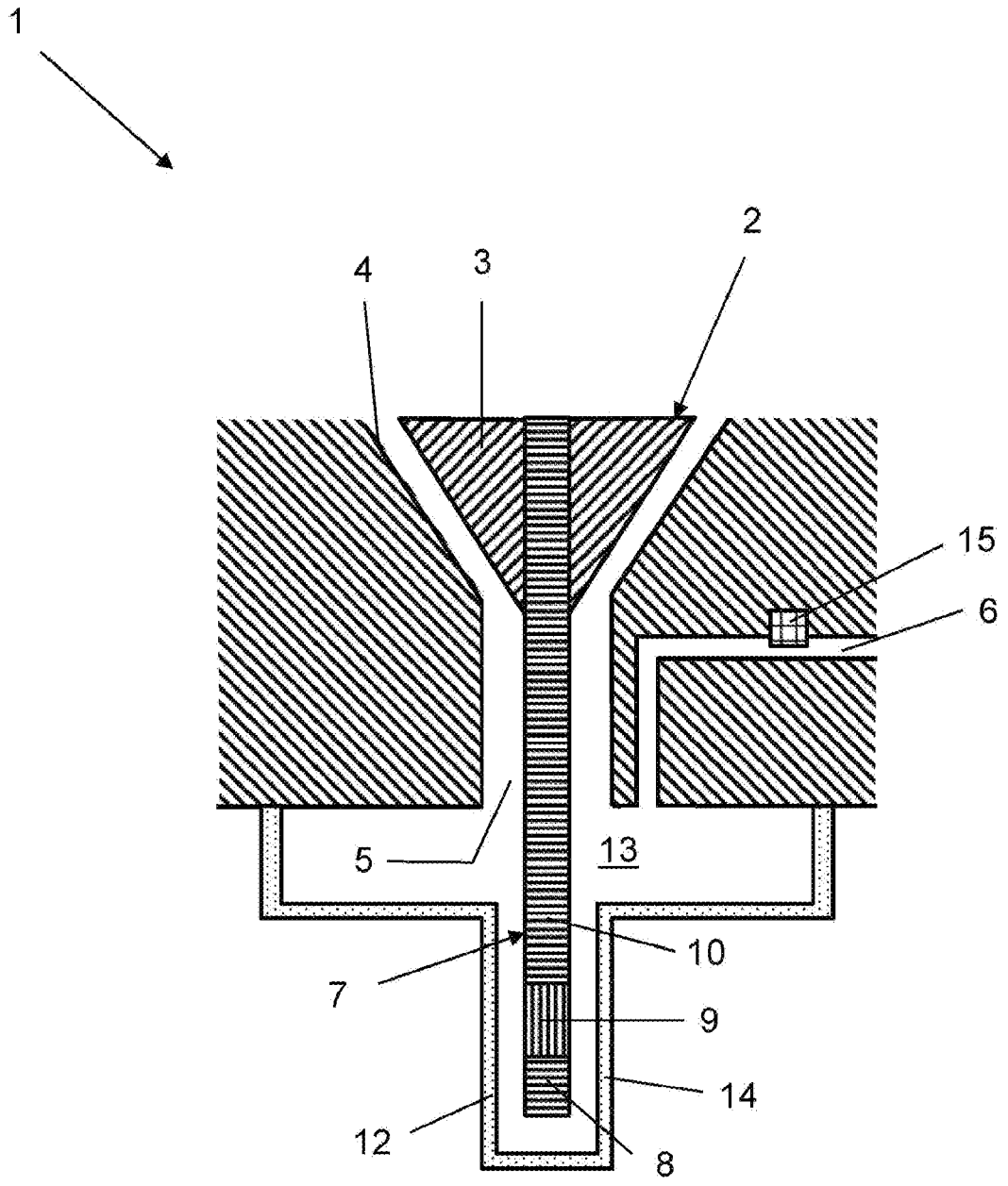
FIG. 2 shows the filling element of FIG. 1, with an attached flushing sleeve.

FIG. 2 shows a schematic section through the filling element 1 in accordance with FIG. 1, with a closure element 12 connected to it, which is configured as a flushing sleeve, in accordance with at least one possible exemplary embodiment. In this situation, the closure element 12 closes tight with the filling element 1, and therefore forms a flushing chamber 13, in which the filling valve 2 and the filling-level probe 7 are accommodated, i.e., the closure element 12 forms with the filling element 1 a fluid-tight flushing chamber 13, which connects to the liquid channel 5 on the underside of the closure element 12, and in which at least the end of the filling-level probe 7 on the free-end side is accommodated. The gas channel 6 is also in fluid connection with the flushing chamber 13.

The closure element 12 shown in FIG. 2 is, for example, manually suspended or installed into the connection device 11, or detachably connected to it. It is also possible, however, for the closure element 12 to be automatically activated. For example, the closure element 12 can be configured as a flushing cap. The particular configuration of the closure element 12 as manually installed or automatically installed, however, does not substantially affect the cleaning apparatus and method.

For the CIP cleaning, a cleaning medium is now introduced into the flushing chamber 13 via the filling valve 2 and the liquid channel 5. Accordingly, the cleaning medium reaches both the filling valve 2 as well as the filling-level probe 7. In at least one possible exemplary embodiment, the cleaning medium is conveyed away out of the flushing chamber 13 again via the gas channel 6, such that a circuit-like conveying of the cleaning medium is formed. The cleaning medium can also be conveyed in the reverse direction, such that it enters the flushing chamber 13 via the gas channel 6 and leaves the flushing chamber 13 again via the liquid channel 5 and the filling valve 2.

As the cleaning medium, very widely differing cleaning liquids come into consideration, among them also very powerful cleaning liquids such as acids and alkalis, or water, which can be used for the flushing. Usually, different cleaning liquids are used one after another. For example, first an acid and then an alkali can be used for cleaning, and then water used for flushing.

The objective or goal of at least one possible exemplary embodiment disclosed herein is that all the filling elements 1 of a filling machine are cleaned and/or flushed. For this purpose the method according to at least one possible exemplary embodiment disclosed herein is used. When the cleaning medium fills the flushing chamber 13, the cleaning medium establishes an electrical connection between the measurement region 8 of the filling-level probe 7 and the electrical ground region 14 of the electrically-conductive closure element 12. Via this conductive connection established by the cleaning medium, a current circuit is closed, as a result of which current flows in the circuit. This current flow is measured and a current flow which is present indicates that the cleaning medium has reached the filling element 1.

As an alternative or in addition to this, the circuit can also be closed by the electrical ground region 10 of the filling-level probe 7. Whether the circuit is closed by the electrical ground region 14 of the closure element 12, the electrical ground region 10 of the filling-level probe 7, or by both electrical ground regions 14 and 10, depends on the details of the circuit used. With an electrically-isolated closure element 12, the closing of the circuit by the electrical ground region 14 of the closure element 12, for example, is not possible.

A control unit, not represented here but such as the control unit 106, registers that the filling-level probe 7 has detected a current flow. This information, together with date and time, is recorded on a recording medium, such that the cleaning of the filling element 1 which has been carried out can also still be proved subsequently. The recording can in this situation be carried out directly by the control unit, or by a central data processing system of the filling machine, to which the measurement result has been forwarded.

In addition to the detection that a current flow is present in the circuit, in at least one possible exemplary embodiment the resistance between the measurement region 8 and the electrical ground region 14 and/or 10 is also determined. It is possible to calculate the electrical conductivity of the cleaning medium by using a factor that is derived from the known geometry of the filling-level probe 7 and of the closure element 12 or is determined experimentally.

The electrical conductivity of the cleaning medium, determined by the filling-level probe 7, is compared with the known value of the electrical conductivity of the cleaning medium. If the values concur within a certain tolerance range, then there is a high degree of probability that the correct cleaning medium has arrived in the flushing chamber 13. These values can also be recorded in order to allow for later proof.

In addition to or as an alternative to the known value of the electrical conductivity, the electrical conductivity of the cleaning medium can also be measured with a conductivity measuring device 15 arranged in the gas channel 6. The conductivity measuring device 15 can of course also be arranged in the liquid channel 5 or in a central gas channel or liquid channel.

If, in addition, the temperature of the cleaning medium is measured in the vicinity of the conductivity measuring device 15, it is possible, by way of the known temperature dependency on the conductivity and the conductivity measured at the filling-level probe 7, for the temperature of the cleaning medium at the filling-level probe 7 also to be calculated.

The control unit detects at least the point of time at which the cleaning medium has arrived at all the filling elements 1 which are to be cleaned. From this time, if appropriate after a predetermined period for the cleaning medium to take effect, the next cleaning step is initiated.

Figure 3:
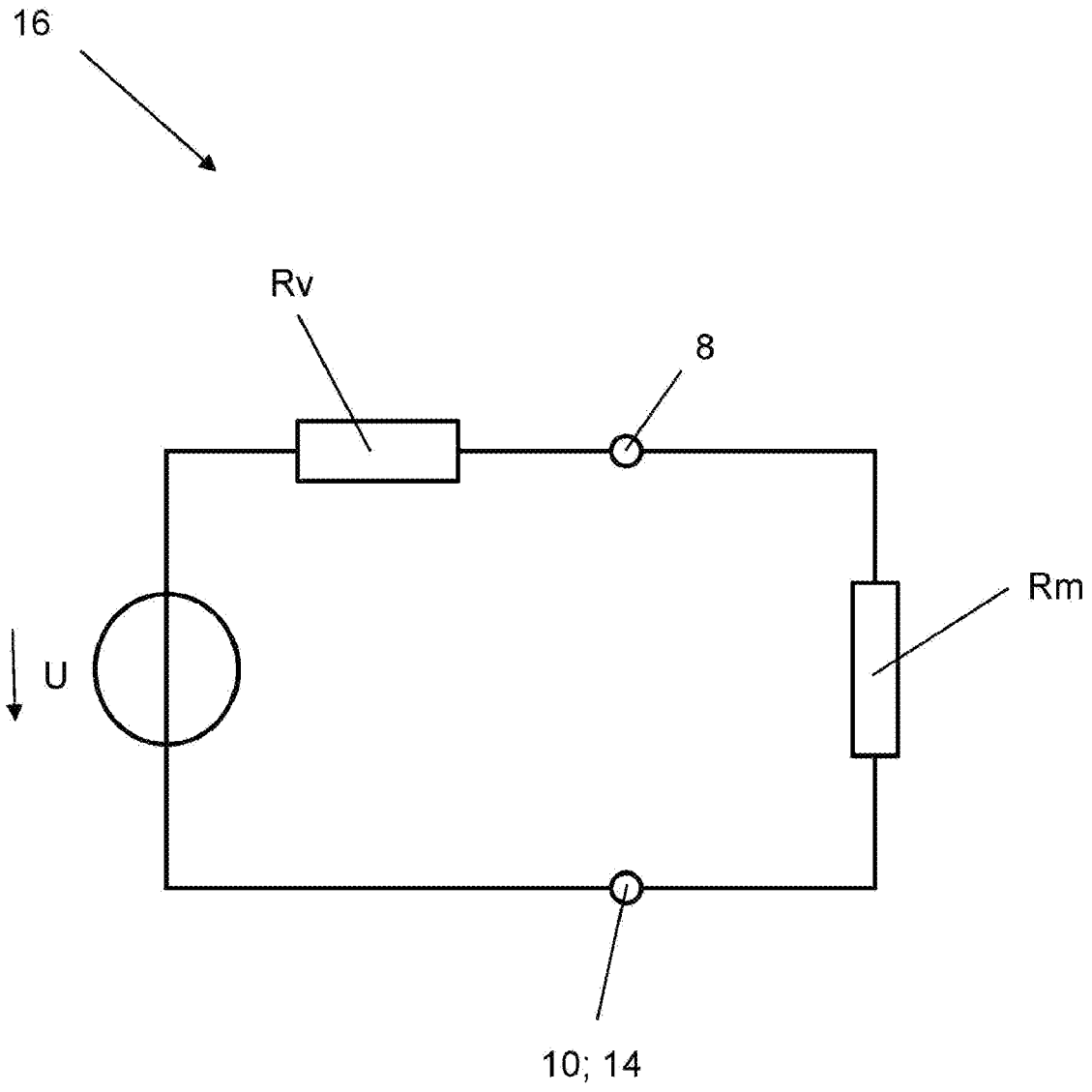
FIG. 3 shows a measurement schematic.

FIG. 3 shows an exemplary measurement circuit 16. In this situation, a voltage U is imposed between the measurement region 8 and the electrical ground region 10 or 14 by way of a series resistor Rv. The voltage U can be a periodic voltage, such that electrolysis can be avoided at the measuring region 8 and/or electrical ground region 10 or 14. In order to make the measurement easier, the voltage U can be a square-wave-type voltage or a square-wave voltage. As an alternative, a sinusoidal AC voltage can also be used.

Between the measurement region 8 and the electrical ground region 10 or 14, the cleaning medium forms a load resistance Rm. Via the voltage imposed between the measurement region 8 and electrical ground region 10 or 14, the known voltage U, and the known size of the series resistor Rv, the value of the load resistance Rm can be calculated, and from this the conductivity of the cleaning medium can be calculated.

The determination of the load resistance Rm, and therefore the conductivity of the cleaning medium, is at its most precise in this situation if the series resistor Rv and the load resistance Rm are of the same order of size. In order to obtain precise measurements for widely differing cleaning media, the series resistor Rv is configured so as to be adjustable. In this situation, this adjustment of the series resistor Rv can take place automatically.

The invention has been described heretofore on the basis of exemplary embodiments. It is understood that many modifications or derivations are possible, without thereby departing from the scope of protection of the invention as defined by the claims.

The following is at least a partial list of components shown in the figures and their related reference numerals: filling element 1; filling valve 2; cone 3; cone-shaped cut-out opening 4; liquid channel 5; gas channel 6; filling-level probe 7; measurement region 8; isolating region 9; electrical ground region of the filling-level probe 10; connection device 11; closure element 12; flushing chamber 13; electrical ground region of the closure element 14; conductivity measuring device 15; measurement circuit 16; load resistance Rm; series resistor Rv; and voltage U.

At least one possible exemplary embodiment of the present application relates to a method for the CIP cleaning of at least one filling element 1 of a filling machine for the filling of containers with a liquid filling contents, wherein the filling machine comprises a multiplicity of filling positions on a circulating transport element, wherein each filling position comprises a filling element 1 with a filling valve 2 and an electrical filling-level probe 7, for the CIP cleaning filling valve 2 and the electrical filling-level probe 7 are accommodated in a flushing chamber 13, in particular a flushing cap or flushing sleeve, provided by a closure element 12, and at least one cleaning medium is introduced into the flushing chamber 13, wherein, during the CIP cleaning, at least one measurement is carried out with the electrical filling-level probe 7.

At least one other possible exemplary embodiment of the present application relates to the method, wherein the closure element 12 is suspended manually at the filling position and/or is activated automatically.

At least one other possible exemplary embodiment of the present application relates to the method, wherein valves 2, arranged in gas channels and/or liquid channels 6;5 of the filling machine and capable of being activated and controlled, are opened and/or closed in such a way that the cleaning medium is conveyed in a circuit through the filling valve 2.

At least one other possible exemplary embodiment of the present application relates to the method, wherein the measurement is carried out between a measurement region 8 of the filling-level probe 7 and an electrical ground region 10; 14, in particular of the filling-level probe 7 and/or of the closure element 12.

At least one other possible exemplary embodiment of the present application relates to the method, wherein for the measurement in the measurement region 8 of the filling-level probe 7 a periodic voltage U is imposed, in particular a square-wave voltage.

At least one other possible exemplary embodiment of the present application relates to the method, wherein the presence of a cleaning medium is checked, and/or the value of the electrical conductivity of the cleaning medium is measured, as well as the value of an electrical current flow between the measurement region 8 of the filling-level probe 7 and an electrical ground region 10; 14, the value of a voltage drop in a measurement circuit 16, and/or the value of an electrical resistance Rm between the measurement region 8 of the filling-level probe 7 and an electrical ground region 10; 14, in particular of the filling-level probe 7 or of the closure element 12 respectively.

At least one other possible exemplary embodiment of the present application relates to the method, wherein the measurement is carried out with a series resistor Rv, which is preferably adjusted.

At least one other possible exemplary embodiment of the present application relates to the method, wherein a reference measurement is carried out of the electrical conductivity of the cleaning medium, in particular by means of a conductivity measuring device 15 installed in a gas channel and/or liquid channel 6; 5, and preferably the temperature of the cleaning medium at this point is measured.

At least one other possible exemplary embodiment of the present application relates to the method, wherein, from the electrical conductivity measured by the filling-level probe 7, the temperature of the cleaning medium is determined.

At least one other possible exemplary embodiment of the present application relates to the method, wherein at least some measurement results are passed on and/or are recorded.

At least one other possible exemplary embodiment of the present application relates to the method, wherein at a predetermined time after the identification of the cleaning medium by at least one filling-level probe 7 a following cleaning step is initiated or the cleaning is concluded.

At least one possible exemplary embodiment of the present application relates to a filling machine for the filling of containers with a liquid filling contents, wherein the filling machine comprises a multiplicity of filling positions on a circulating transport element, wherein each filling position comprises a filling element 1 with a filling valve 2 and an electrical filling-level probe 7, and the filling valve 2 and the electrical filling-level probe 7 can be accommodated in a flushing chamber 13 provided by a closure element 12, wherein the filling machine comprises a control unit, which is configured such as to carry out the method described herein.

At least one other possible exemplary embodiment of the present application relates to the filling machine, wherein a measuring electronics unit of the filling-level probe 7 comprises an adjustable series resistor Rv.

At least one other possible exemplary embodiment of the present application relates to the filling machine, wherein the filling machine comprises at least one conductivity measuring device 15 installed in a gas channel and/or liquid channel 6, 5, for measuring a reference conductivity.

At least one possible exemplary embodiment of the present application relates to a method for the cleaning-in-place cleaning of at least one filling element of a filling machine for the filling of containers with a liquid filling content, wherein: said filling machine comprises a plurality of filling positions disposed on a rotary transport element; each filling position comprises a filling element; said filling element comprises a filling valve and a filling-level probe; and said method comprising the steps of: connecting a closure element comprising a flushing cap or a flushing sleeve to each said filling element, and thereby forming, together with said filling element, a flushing chamber in which said filling valve and said filling-level probe are at least partially disposed; introducing at least one cleaning medium into said flushing chamber; and performing at least one electrical measurement with said filling-level probe during the cleaning-in-place cleaning of said filling element.

At least one other possible exemplary embodiment of the present application relates to the method, wherein said step of connecting said closure element comprises connecting each said closure element at each said filling element manually and/or automatically.

At least one other possible exemplary embodiment of the present application relates to the method, wherein said method further comprises controlling the flow of said at least one cleaning medium through said filling element by opening and/or closing at least one of: said filling valve in a liquid channel of said filling element and a gas channel valve in a gas channel of said filling element, such that said at least one cleaning medium is conveyed in a circuit through said filling element and said flushing chamber.

At least one other possible exemplary embodiment of the present application relates to the method, wherein said step of performing said at least one electrical measurement comprises performing said at least one electrical measurement between a measurement region of said filling-level probe and at least one electrical ground region disposed on at least one of said filling-level probe and said closure element.

At least one other possible exemplary embodiment of the present application relates to the method, wherein said step of performing said at least one electrical measurement comprises imposing an electric current flow on said measurement region of said filling-level probe having one of a periodic voltage or a square-wave voltage.

At least one other possible exemplary embodiment of the present application relates to the method, wherein said step of performing said at least one electrical measurement comprises at least one of: checking for the presence of a cleaning medium; measuring the value of the electrical conductivity of the cleaning medium; measuring the value of an electrical current flow between said measurement region and said at least one electrical ground region; measuring the value of a voltage drop in a measurement circuit; and measuring the value of an electrical resistance between said measurement region and said at least one electrical ground region.

At least one other possible exemplary embodiment of the present application relates to the method, wherein said step of measuring is carried out with a series resistor configured to be adjusted.

At least one other possible exemplary embodiment of the present application relates to the method, wherein said method further comprises: establishing a reference measurement by measuring the electrical conductivity of the cleaning medium using a conductivity measuring device disposed in at least one of said gas channel and said liquid channel; and measuring the temperature of the cleaning medium in at least one of said gas channel and said liquid channel.

At least one other possible exemplary embodiment of the present application relates to the method, wherein said method further comprises determining the temperature of the cleaning medium using the electrical conductivity measured by said filling-level probe.

At least one other possible exemplary embodiment of the present application relates to the method, wherein said method further comprises at least one of passing on or recording at least some of the measurement results.

At least one other possible exemplary embodiment of the present application relates to the method, wherein, at a predetermined time after the identification of the cleaning medium by said filling-level probe, either concluding the cleaning or initiating a subsequent cleaning step.

At least one possible exemplary embodiment of the present application relates to a filling machine for the filling of containers with a liquid filling content, said filling machine comprising: a plurality of filling positions disposed on a rotary transport element; each filling position comprising a filling element; said filling element comprising a filling valve and a filling-level probe; at least one closure element being configured and disposed to form, together with said filling element, a flushing chamber in which said filling valve and said filling-level probe are at least partially disposed for the cleaning-in-place cleaning of said filling element; and a control unit being configured to control: the flow of cleaning medium into said flushing chamber; and the performance of at least one electrical measurement with said filling-level probe during the cleaning-in-place cleaning of said filling element.

At least one other possible exemplary embodiment of the present application relates to the filling machine, wherein said filling-level probe comprises a measuring electronics unit, which comprises an adjustable series resistor.

At least one other possible exemplary embodiment of the present application relates to the filling machine, wherein said filling machine comprises at least one conductivity measuring device installed in a gas channel and/or a liquid channel of said filling element, and configured to measure a reference conductivity of a cleaning medium.

At least one other possible exemplary embodiment of the present application relates to the filling machine, wherein: said closure element is configured to be connected manually and/or automatically at said filling position; and said control unit is configured to control the flow of at least one cleaning medium through said filling element by opening and/or closing at least one of: said filling valve in a liquid channel of said filling element and a gas channel valve in a gas channel of said filling element, such that said at least one cleaning medium is conveyed in a circuit through said filling element and said flushing chamber.

At least one other possible exemplary embodiment of the present application relates to the filling machine, wherein: said filling-level probe comprises a measurement region; at least one of said filling-level probe and said closure element comprises at least one electrical ground region; and said control unit is configured to control the performance of at least one electrical measurement using said measurement region and said at least one electrical ground region.

At least one other possible exemplary embodiment of the present application relates to the filling machine, wherein said control unit is configured to control the performance of said at least one electrical measurement by imposing an electric current flow on said measurement region of said filling-level probe having one of a periodic voltage or a square-wave voltage At least one other possible exemplary embodiment of the present application relates to the filling machine, wherein said control unit is configured to control the performance of at least one of: a check for the presence of a cleaning medium; a measurement of the value of the electrical conductivity of the cleaning medium; a measurement of the value of an electrical current flow between said measurement region and said at least one electrical ground region; a measurement of the value of a voltage drop in a measurement circuit; and a measurement of the value of an electrical resistance between said measurement region and said at least one electrical ground region.

At least one other possible exemplary embodiment of the present application relates to the filling machine, wherein said control unit is configured to determine the temperature of the cleaning medium using the electrical conductivity of the cleaning medium measured by said filling-level probe.

At least one other possible exemplary embodiment of the present application relates to the filling machine, wherein said control unit is configured, upon a predetermined time after the identification of the cleaning medium by said filling-level probe, to either conclude the cleaning or initiate a subsequent cleaning step.

Any numerical values disclosed herein, if any, should be understood as disclosing all approximate values within plus or minus ten percent of the numerical value. Any ranges of numerical values disclosed herein, if any, should be understood as disclosing all individual values within the range of values, including whole numbers, tenths of numbers, or hundredths of numbers.

The entirety of the appended drawings, including all dimensions, proportions, and/or shapes disclosed thereby or reasonably understood therefrom, are hereby incorporated by reference.

All of the patents, patent applications, patent publications, and other documents cited herein, are hereby incorporated by reference as if set forth in their entirety herein.

The corresponding foreign or international patent applications, as originally filed and as published, from which the present application claims the benefit of priority, are hereby incorporated by reference as if set forth in their entirety herein, as follows: International Patent Application No. PCT/EP2020/058918, filed Mar. 30, 2020; International Patent Publication No. WO 2020/216579, published Oct. 29, 2020; and Federal Republic of Germany Patent Application No. DE102019110665.6, filed Apr. 25, 2019.

The following patents, patent applications, patent publications, and other documents cited in the corresponding foreign or international patent applications listed in the preceding paragraph are hereby incorporated by reference as if set forth in their entirety herein, as follows: DE10061401 A1; DE102008030291 A1; EP1215166 A1; and EP0672613 A1.

Although the invention has been described in detail for the purpose of illustration of any embodiments disclosed herein, including the most practical or preferred embodiments at the time of filing of this application, it is to be understood that such detail is solely for that purpose and that the invention is not limited to such embodiments, but, on the contrary, is intended to cover modifications and equivalent arrangements that are within the spirit and scope of the present application, including the specification and the claims as originally filed, as amended, or as issued. For example, it is to be understood that the present invention contemplates that, to the extent possible, one or more features or components of any disclosed embodiment can be combined with one or more features or components of any other disclosed embodiment.

What is claimed is:

1. A method for the cleaning-in-place cleaning of at least one filling element of a filling machine for the filling of containers with a liquid filling content, wherein:

said filling machine comprises a plurality of filling positions disposed on a rotary transport element;

each filling position comprises a filling element;

said filling element comprises a filling valve and a filling-level probe; and said method comprising:

connecting a closure element comprising a flushing cap or a flushing sleeve to each said filling element, and thereby forming, together with said filling element, a flushing chamber in which said filling valve and said filling-level probe are at least partially disposed;

introducing at least one cleaning medium into said flushing chamber; and performing at least one electrical measurement with said filling-level probe during the cleaning-in-place cleaning of said filling element.

2. The method according to claim 1, wherein said step of connecting said closure element comprises connecting each said closure element at each said filling element manually and/or automatically.

3. The method according to claim 2, wherein said method further comprises controlling the flow of said at least one cleaning medium through said filling element by opening and/or closing at least one of: said filling valve in a liquid channel of said filling element and a gas channel valve in a gas channel of said filling element, such that said at least one cleaning medium is conveyed in a circuit through said filling element and said flushing chamber.

4. The method according to claim 3, wherein said step of performing said at least one electrical measurement comprises performing said at least one electrical measurement between a measurement region of said filling-level probe and at least one electrical ground region disposed on at least one of said filling-level probe and said closure element.

5. The method according to claim 4, wherein said step of performing said at least one electrical measurement comprises imposing an electric current flow on said measurement region of said filling-level probe having one of a periodic voltage or a square-wave voltage.

6. The method according to claim 5, wherein said step of performing said at least one electrical measurement comprises at least one of:

checking for the presence of a cleaning medium;

measuring the value of the electrical conductivity of the cleaning medium;

measuring the value of an electrical current flow between said measurement region and said at least one electrical ground region;

measuring the value of a voltage drop in a measurement circuit; and measuring the value of an electrical resistance between said measurement region and said at least one electrical ground region.

7. The method according to claim 6, wherein said step of measuring is carried out with a series resistor configured to be adjusted.

8. The method according to claim 7, wherein said method further comprises:

establishing a reference measurement by measuring the electrical conductivity of the cleaning medium using a conductivity measuring device disposed in at least one of said gas channel and said liquid channel; and measuring the temperature of the cleaning medium in at least one of said gas channel and said liquid channel.

9. The method according to claim 8, wherein said method further comprises determining the temperature of the cleaning medium using the electrical conductivity measured by said filling-level probe.

10. The method according to claim 9, wherein said method further comprises at least one of passing on or recording at least some of the measurement results.

11. The method according to claim 10, wherein, at a predetermined time after the identification of the cleaning medium by said filling-level probe, either concluding the cleaning or initiating a subsequent cleaning step.

12. A filling machine for the filling of containers with a liquid filling content, said filling machine comprising:

a plurality of filling positions disposed on a rotary transport element;

each filling position comprising a filling element;

said filling element comprising a filling valve and a filling-level probe;

at least one closure element being configured and disposed to form, together with said filling element, a flushing chamber in which said filling valve and said filling-level probe are at least partially disposed for the cleaning-in-place cleaning of said filling element; and a control unit being configured to control:

the flow of cleaning medium into said flushing chamber; and the performance of at least one electrical measurement with said filling-level probe during the cleaning-in-place cleaning of said filling element.

13. The filling machine according to claim 12, wherein said filling-level probe comprises a measuring electronics unit, which comprises an adjustable series resistor.

14. The filling machine according to claim 13, wherein said filling machine comprises at least one conductivity measuring device installed in a gas channel and/or a liquid channel of said filling element, and configured to measure a reference conductivity of a cleaning medium.

15. The filling machine according to claim 12, wherein:

said closure element is configured to be connected manually and/or automatically at said filling position; and said control unit is configured to control the flow of at least one cleaning medium through said filling element by opening and/or closing at least one of: said filling valve in a liquid channel of said filling element and a gas channel valve in a gas channel of said filling element, such that said at least one cleaning medium is conveyed in a circuit through said filling element and said flushing chamber.

16. The filling machine according to claim 15, wherein:

said filling-level probe comprises a measurement region;

at least one of said filling-level probe and said closure element comprises at least one electrical ground region; and said control unit is configured to control the performance of at least one electrical measurement using said measurement region and said at least one electrical ground region.

17. The filling machine according to claim 16, wherein said control unit is configured to control the performance of said at least one electrical measurement by imposing an electric current flow on said measurement region of said filling-level probe having one of a periodic voltage or a square-wave voltage.

18. The filling machine according to claim 17, wherein said control unit is configured to control the performance of at least one of:

a check for the presence of a cleaning medium;

a measurement of the value of the electrical conductivity of the cleaning medium;

a measurement of the value of an electrical current flow between said measurement region and said at least one electrical ground region;

a measurement of the value of a voltage drop in a measurement circuit; and a measurement of the value of an electrical resistance between said measurement region and said at least one electrical ground region.

19. The filling machine according to claim 18, wherein said control unit is configured to determine the temperature of the cleaning medium using the electrical conductivity of the cleaning medium measured by said filling-level probe.

20. The filling machine according to claim 19, wherein said control unit is configured, upon a predetermined time after the identification of the cleaning medium by said filling-level probe, to either conclude the cleaning or initiate a subsequent cleaning step.

* * * * *